United States Patent [19]

Pollmann et al.

[11] Patent Number: 4,615,284

[45] Date of Patent: Oct. 7, 1986

[54] METHOD OF BINDING VANADIUM COMPOUNDS

[75] Inventors: Siegfried Pollmann; Klaus Grethe, both of Gummersbach, Fed. Rep. of Germany

[73] Assignee: L. & C. Steinmüller GmbH, Gummersbach, Fed. Rep. of Germany

[21] Appl. No.: 625,597

[22] Filed: Jun. 28, 1984

[30] Foreign Application Priority Data

Jul. 1, 1983 [DE] Fed. Rep. of Germany ..... 3323754

[51] Int. Cl.[4] ..... F23B 7/00

[52] U.S. Cl. ..... 110/343; 44/DIG. 3; 110/342; 110/344; 110/345

[58] Field of Search ..... 110/342, 343, 344, 345; 44/DIG. 3

[56] References Cited

U.S. PATENT DOCUMENTS 3,980,449 9/1976 Zetlmeisl et al. ..... 44/DIG. 3

4,190,421 2/1980 Hwa ..... 110/343 X

*Primary Examiner*—Edward G. Favors

*Attorney, Agent, or Firm*—Becker & Becker, Inc.

[57] ABSTRACT

A method of binding vanadium compounds which are formed as reaction products during the combustion of solid or fluid petroleum residues in vapor generators. The binding of the vanadium compounds is effected within the framework of a combustion with alkali earth containing coals which are preferably high-ash coals. With solid petroleum residues, the coal is mixed with the residue prior to entry into the combustion zone. With fluid petroleum residues, the coal is introduced into the combustion zone via a burner along with, yet separate from, the residues.

2 Claims, No Drawings

METHOD OF BINDING VANADIUM COMPOUNDS

BACKGROUND OF THE INVENTION

1. Field of the Invention

The present invention relates to a method of binding vanadium compounds which are formed as reaction products when solid or fluid petroleum residue is burned in vapor generators.

Solid or fluid petroleum residues are formed when crude oil is processed. These residues contain heavy metals in a highly-concentrated form, especially vanadium compounds, but apart from that are suitable for thermal energy exploitation due to their high heating value. When the relatively high heating value of these residues is exploited by combustion in conventionally fired vapor generators, the vanadium leads to high temperature corrosion on heat transfer surfaces, and especially on uncooled supporting parts, when the temperatures thereof are greater than about 540° C. In this temperature range, the vanadium oxide, together with the sodium oxide which is also present in the flue gas, form corrosive chemical compounds, especially the sodium vanadyl vanadates $Na_2O.V_2O_4.5\ V_2O_5$ and $5\ Na_2O.V_2O_4.11V_2O_5$.

2. Description of the Prior Art

It is known that vanadium can be chemically bound by adding additives such as MgO and other alkaline earths. This results in a reduction of the corrosive vanadium compounds, which melt at relatively low temperatures. The addition of such additives was already tested with the combustion of vanadium-containing oils in large-scale vapor generators, where the vanadium contents of the fuels utilized was less than is the case with the aforementioned petroleum residues which result from the processing of crude oil. For example, with a vanadium content of 141 ppm in a heavy oil, a distinct reduction of the rate of corrosion was measured when the molar ratio of magnesium to vanadium was 5:1.

In order to achieve corresponding effects when the aforementioned petroleum residues are burned, it is necessary, as a result of the considerably greater vanadium content, to also use a correspondingly greater amount of additive in order to bind the vanadium compounds. The quantity of solid material resulting therefrom during combustion of the fluid residues in a vapor generator which is designed for firing heavy oil could not be removed to the extent necessary because the separation system for the solid material does not have an adequate capacity. Another drawback is that the dust contained in the flue gas would discharge large amounts of heavy metals into the atmosphere, thereby greatly polluting the latter.

The conditions are similar for the combustion of solid petroleum residues in conventional vapor generators.

An object of the present invention is to provide a method with which the vanadium constituents which are present in solid or fluid petroleum residues to a large extent lose their corrosive properties when they are burned in vapor generators, and with which the emission values of these constituents are reduced to an environmentally acceptable value.

This object, and other objects and advantages of the present invention, will appear more clearly from the following specification.

SUMMARY OF THE INVENTION

The method of the present invention is characterized primarily in that the binding of the vanadium compounds is effected within the framework of a combustion with alkaline earth containing coal, preferably high-ash coal. For solid petroleum residues, the coal is mixed with the residues prior to entry into the combustion zones, and with fluid petroleum residues, the coal is introduced into the combustion zone via the burner along with, yet separate from, the residues.

Pursuant to the present invention, there is achieved in an advantageous manner that the ash-high, alkaline-earth containing coals act as a natural additive, so that there is no need for additional additives for binding the vanadium-containing compounds. Due to chemical reactions of the vanadium compounds in the petroleum residues with the alkali earth compounds in the coal ashes, high-melting alkali earth vanadates are formed, so that there is reduced to a large extent high temperature corrosion on the superheater heat transfer surfaces which would otherwise be caused by low-melting sodium vanadyl vanadates. A further advantage is that use of known burner constructions does not require that structural measures be undertaken on the pulverized-coal burner, regardless of whether with solid petroleum residues the latter are mixed prior to entry into the combustion zone, or with fluid petroleum residues the latter are introduced separately into the combustion zone. For example, for solid petroleum residues, the burner disclosed in German Pat. No. 29 08 448 can be utilized without difficulty because the coal-petroleum mixture is supplied via the powder-laden air tube. When fluid vanadium-containing residues are burned, they are fed via an atomizing lance in the central core-air tube. Environmental pollution from heavy metals is also reduced by a considerable extent, because the vanadium bound in the coal ash is taken care of by the ash removal system present in the vapor generator.

The present invention, of course, in no way restricted to the specific disclosure of the specification, but also encompasses any modifications within the scope of the appended claims.

What we claim is:

1. A method of binding vanadium compounds which are formed as reaction products during the combustion of solid or fluid petroleum residues in vapor generators undertaken without any separately produced additional additive; said method comprising the step of effecting said combustion with coal having an adequate alkaline earth content; with solid petroleum residues, said coal being mixed with said residues prior to entry into a combustion zone, and with fluid petroleum residues, said coal being introduced into a combustion zone, via a burner, along with, yet separate from, said residues.

2. A method according to claim 1, which includes the step of using high-ash, alkaline earth containing coal.

* * * * *